US011542795B2

(12) United States Patent
Yin et al.

(10) Patent No.: US 11,542,795 B2
(45) Date of Patent: Jan. 3, 2023

(54) MECHANICAL ISOLATION PLUGS FOR INFLOW CONTROL DEVICES

(71) Applicant: HALLIBURTON ENERGY SERVICES, INC., Houston, TX (US)

(72) Inventors: Weiqi Yin, Plano, TX (US); William David Henderson, Tioga, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 41 days.

(21) Appl. No.: 17/349,826

(22) Filed: Jun. 16, 2021

(65) Prior Publication Data

US 2021/0324715 A1 Oct. 21, 2021

Related U.S. Application Data

(62) Division of application No. 16/698,043, filed on Nov. 27, 2019, now Pat. No. 11,066,909.

(51) Int. Cl.
*E21B 43/12* (2006.01)
*E21B 33/12* (2006.01)

(52) U.S. Cl.
CPC ..... *E21B 43/12* (2013.01); *E21B 33/12* (2013.01)

(58) Field of Classification Search
CPC ..... E21B 33/12; E21B 43/12
See application file for complete search history.

(56) References Cited

U.S. PATENT DOCUMENTS 2,321,003 A 6/1943 Boynton
2,781,240 A * 2/1957 Art ..... F16J 9/28 277/436
3,362,347 A 1/1968 Canalizo
4,224,993 A * 9/1980 Huckaby ..... E21B 34/10 166/325
5,609,178 A 3/1997 Hennig et al.
(Continued)

FOREIGN PATENT DOCUMENTS

WO WO-2018194560 A1 10/2018

OTHER PUBLICATIONS

Korean Intellectual Property Office, International Search Report and Written Opinion, PCT/US2019/063706, dated Aug. 25, 2020, 10 pages, Korea.

*Primary Examiner* — Dany E Akakpo
(74) *Attorney, Agent, or Firm* — Scott Richardson; Parker Justiss, P.C.

(57) ABSTRACT

Isolation plugs may be installed in a wellbore flow control device to temporarily close a flow path therethrough. The isolation plugs may be installed in threaded openings often provided to for access to nozzles or other flow restrictors in the flow control devices. The isolation plugs may initially be locked in a closed configuration while being run in hole and may be unlocked in response to the application of a predetermined activation pressure. Once unlocked, the isolation plug may not immediately move to an open configuration but may continue holding pressure to permit circulation and washdown operations to be conducted. The activation pressure may be reduced to a second predetermined threshold to lock the isolation plug in the open configuration wherein flow is permitted through the flow control device.

20 Claims, 9 Drawing Sheets

(56) References Cited

U.S. PATENT DOCUMENTS

| | | | |
|---|---|---|---|
| 6,349,772 | B2 | 2/2002 | Mullen et al. |
| 6,957,703 | B2 | 10/2005 | Trott et al. |
| 7,409,999 | B2 | 8/2008 | Henriksen |
| 7,775,283 | B2 | 8/2010 | Coronado et al. |
| 7,789,145 | B2 | 9/2010 | Patel |
| 7,823,645 | B2 | 11/2010 | Henriksen et al. |
| 8,104,535 | B2 | 1/2012 | Sierra et al. |
| 8,256,522 | B2 | 9/2012 | Veit et al. |
| 8,371,386 | B2 | 2/2013 | Malone |
| 8,403,052 | B2 | 3/2013 | Veit |
| 8,448,659 | B2 | 5/2013 | Veit |
| 8,453,736 | B2 | 6/2013 | Constantine |
| 8,469,105 | B2 | 6/2013 | O'Malley et al. |
| 8,485,225 | B2 | 7/2013 | Veit |
| 8,485,258 | B2 | 7/2013 | Mathiesen et al. |
| 8,657,016 | B2 | 2/2014 | Greci et al. |
| 8,794,329 | B2 | 8/2014 | Holderman |
| 8,833,469 | B2 | 9/2014 | Purkis |
| 8,985,207 | B2 | 3/2015 | Thorkildsen et al. |
| 9,341,049 | B2 | 5/2016 | Hailey, Jr. et al. |
| 9,562,414 | B2 | 2/2017 | Holderman et al. |
| 9,617,836 | B2 | 4/2017 | Garcia et al. |
| 9,644,461 | B2 | 5/2017 | Castillo et al. |
| 9,663,997 | B2 | 5/2017 | Kang et al. |
| 9,683,426 | B2 | 6/2017 | Lopez et al. |
| 9,695,654 | B2 | 7/2017 | Stephenson et al. |
| 2009/0000787 | A1 | 1/2009 | Hill et al. |
| 2010/0000727 | A1 | 1/2010 | Webb et al. |
| 2011/0073308 | A1 | 3/2011 | Assal et al. |
| 2013/0276901 | A1 | 10/2013 | Holderman et al. |
| 2013/0277059 | A1 | 10/2013 | Holderman et al. |
| 2014/0034308 | A1 | 2/2014 | Holderman et al. |
| 2016/0003005 | A1 | 1/2016 | Pickle et al. |
| 2016/0265308 | A1 | 9/2016 | Arias et al. |

* cited by examiner

MECHANICAL ISOLATION PLUGS FOR INFLOW CONTROL DEVICES

CROSS-REFERENCE TO RELATED APPLICATIONS

This application is a Divisional of U.S. patent application Ser. No. 16/698,043, filed Nov. 27, 2019.

BACKGROUND

The present disclosure relates generally to well completion systems and associated operations for use in a subterranean wellbore. Example embodiments described herein include flow control devices with mechanical mechanisms that selectively open a flow path through the control devices while deployed in the wellbore.

In hydrocarbon production operations, well completions have been employed that have down-hole flow control devices therein. The flow control devices facilitate balancing inflow into the wellbore or injection from the wellbore along a length of the completion. The flow control devices may also assist in the delay gas and water breakthrough, increase a lifespan of the wellbore and improve overall hydrocarbon recovery. Some completions use a wash pipe to act as a conduit for fluid returns as well to carry a shifting mechanism to open or close a flow path through the flow control devices. However, the use of a wash pipe, especially in long horizontal wells, may be associated with a loss of valuable rig time due to make-up and break-up of the wash pipe, or the time allocated for recovery operations if the wash pipe becomes stuck. Thus, by constructing wellbore completions with flow control devices that do not require the use of a wash pipe may reduce operation time, costs and associated risks.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure relates generally to isolation plugs that may be installed in a flow control device such as an inflow control device (ICD). The isolation plugs may temporarily close a flow path through the flow control devices, e.g., while the flow control devices are run in hole and installed. When an activation pressure applied to an isolation plug exceeds a first predetermined threshold, the isolation plug may be unlocked, but may not immediately move to an actuated configuration to open the flow path through the flow control device. The isolation plug may continue holding pressure to permit circulation and washdown operations to be conducted. Once the activation pressure is reduced to a second predetermined threshold, the isolation plugs move to the actuated configuration where the isolation plugs are locked in place to permit the flow control devices to be opened for production or injection operations. The isolation plugs may be self-contained within a sleeve configured with threads for engaging exiting threads in a fluid control device. Various mechanical mechanisms including springs, collets, ratchets and shear pins are described for maintaining the isolation plugs in the initial and activated configurations.

Figure 1:
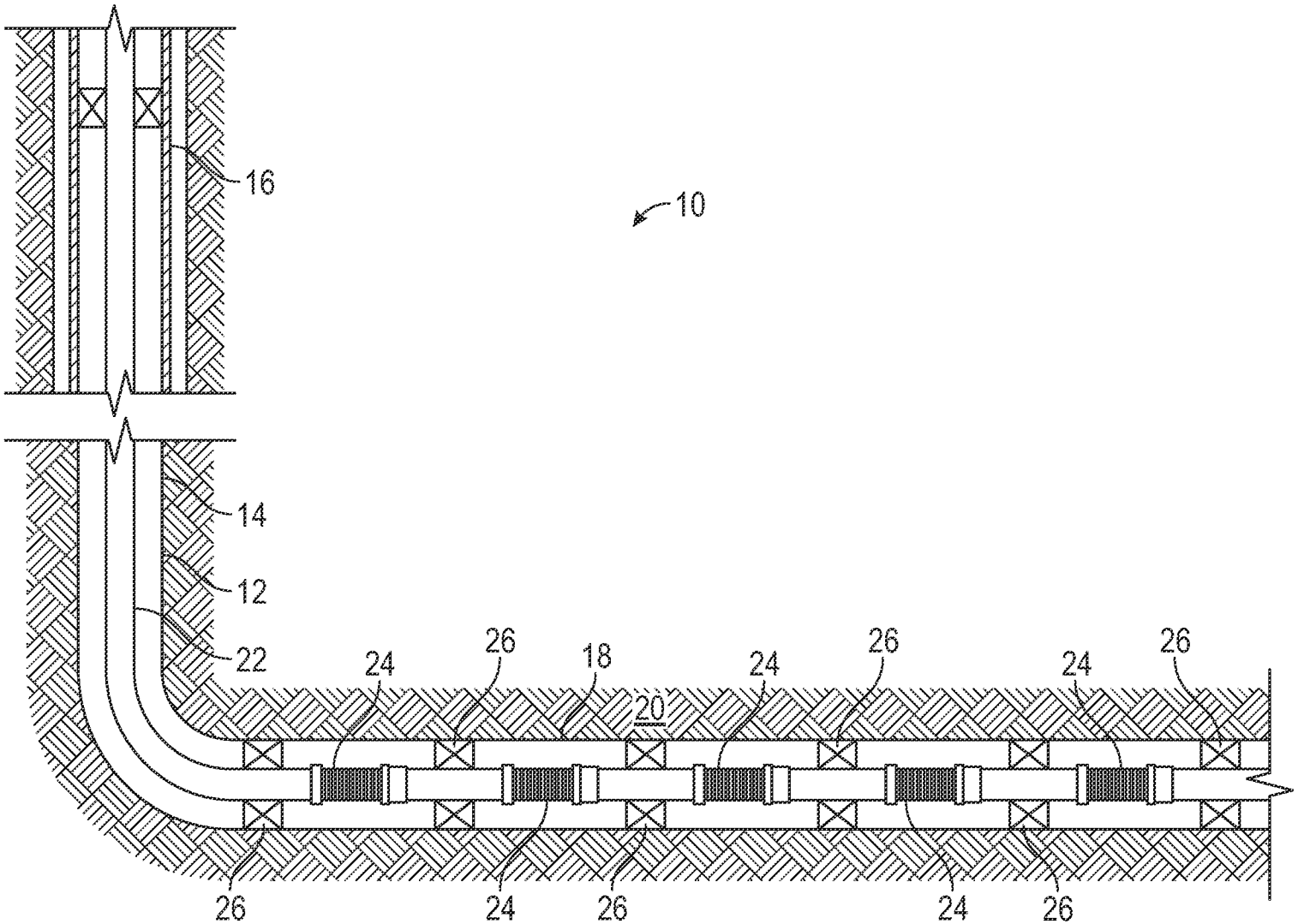
FIG. 1 is a partial, cross-sectional side view of a wellbore system including a plurality of flow control devices therein which may employ aspects of the present disclosure.

Referring initially to FIG. 1, a wellbore system 10 includes a plurality of downhole fluid flow control screens 24 therein, which may be equipped with an isolation plug 100 (FIG. 3A) according to certain illustrative embodiments of the present disclosure. In the illustrated embodiment, a wellbore 12 extends through a geologic formation 20. Wellbore 12 has a substantially vertical section 14, the upper portion of which has a casing string 16 cemented therein. A substantially horizontal section 18 of wellbore 12 extends through a hydrocarbon bearing portion of the geological formation 20. As illustrated, substantially horizontal section 18 of wellbore 12 is open hole. In other embodiments, the wellbore 12 may be fully cased or extend along alternate trajectories including deviated or slanted portions, multilateral portions and other wellbore features without departing from the principles of the disclosure.

Positioned within wellbore 12 and extending from a surface location (not shown) is a tubing string 22. Tubing string 22 provides a conduit for hydrocarbons or other formation fluids to travel from formation 20 to the surface location and for injection fluids to travel from the surface to formation 20. At its lower end, the tubing string 22 defies a completion string that divides the horizontal section 18 into various production intervals adjacent to formation 20. The tubing string 22 includes a plurality of flow control screens 24 coupled therein, each of which is positioned between a pair of annular barriers such as packers 26. The packers 26 provides a fluid seal between the tubing string 22 and geologic formation 20, thereby defining the production intervals. Any number of flow control screens 24 or other flow control devices may be deployed within a single production interval between packers 26, and/or within a completion interval that does not include production intervals without departing from the principles of the present disclosure Flow control screens 24 may operate to filter particulate matter out of fluids collected from the formation 20 and may include flow restrictors therein to regulate the flow therethrough during production operations. Alternatively, or additionally, the flow control screens 24 may be operable to control the flow of an injection fluid stream from the tubing string 22 into the formation 20. As explained in greater detail below one or more isolation plugs 100 (FIG. 3) may be installed in each of the flow control screens to selectively open a flow path through the flow control screens 24.

Figure 2:
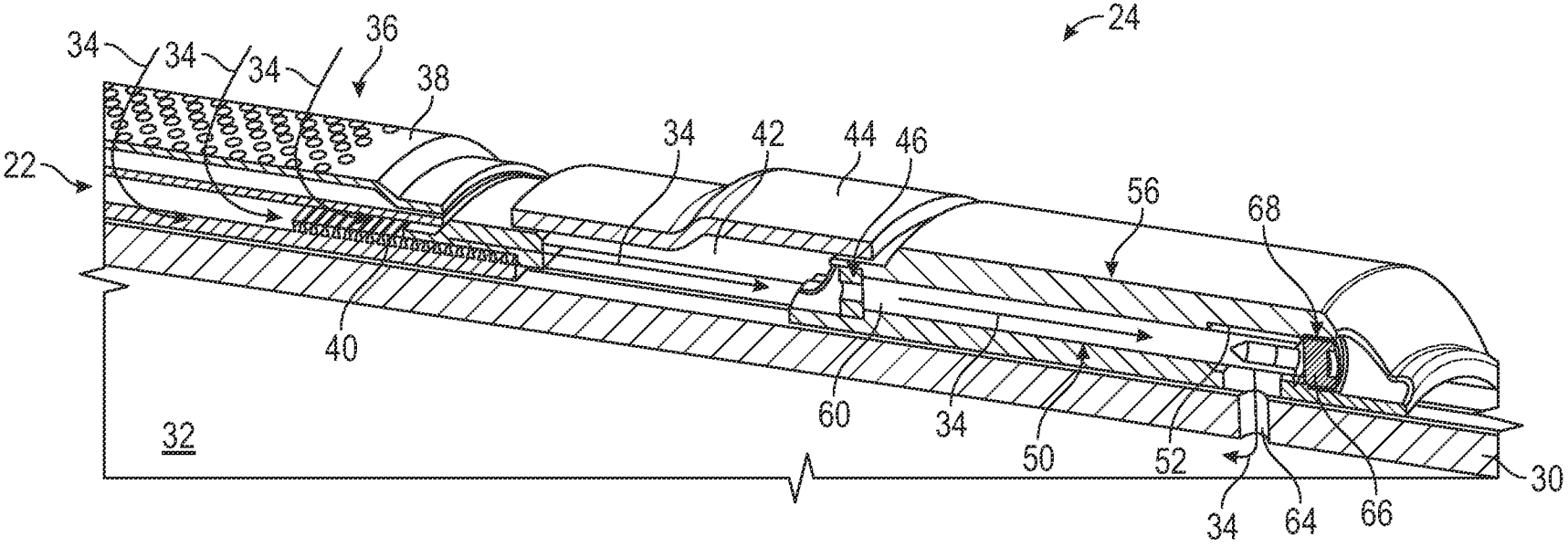
FIG. 2 is a partial, cross-sectional perspective view of one of the flow control devices of FIG. 1 illustrating a flow path therethrough.

Referring to FIG. 2, a flow control screen 24 includes a base pipe 30, which may be connected in the tubing string 22. As illustrated, an interior passageway 32 of the base pipe 30 receives production fluids 34 from an annulus 36 surrounding the flow control screen 24 in the wellbore 12 (FIG. 1). The production fluids 34 may first pass through an outer sheath 38, which may be constructed of a perforated metal sheet wrapped circumferentially around the base pipe 30. The production fluid 34 next flows a filter element 40 where particulates may be removed. The filter element 40 may be constructed as a wire wrap screen, a woven wire mesh screen, a prepacked screen, etc., arranged to permit fluids to flow therethrough but prevent particulate matter of a predetermined size from passing. In other embodiments, a fluid control device may be provided without a filter element without departing from the scope of the disclosure.

After passing through the filter element 40, the production fluid 34 passes through an annular chamber 42 defined between the base pipe 30 and a screen interface housing 44. The production fluid 34 is then guided into one or more flow restrictors, such as nozzles 46. Nozzles 46 impart a desired flow resistance to the production fluid flow 34 to achieve the desired pressure drop and flowrate therethrough. Thereafter, the production fluid 34 flows through fluid path 50 and annulus 52 defined between the base pipe 30 and a flow control housing 56. In some embodiments, an adjustment rod 60 may be provided in the fluid path 50 and annulus 52 to change the direction or flow resistance of the production fluid 34 before the production fluid 34 is discharged through radial openings 64 into the interior passageway 32 of the base pipe 30 for production to the surface.

At its downhole end, flow control housing 56 contains a plug 66, used to prevent production fluid 34 from leaking out of the flow control housing 56. The plug 66 may be removed to provide an access port to service, remove and/or replace nozzles 46 and adjustment rods 60. The plug 66 may be sealingly secured to the flow control housing 56 by NPT threads 68, or any other similar connection mechanism. As described in greater detail below, the NPT threads may be employed to secure the isolation plug 100 (FIG. 3A) or any of the isolation plugs described herein.

Figure 3A:
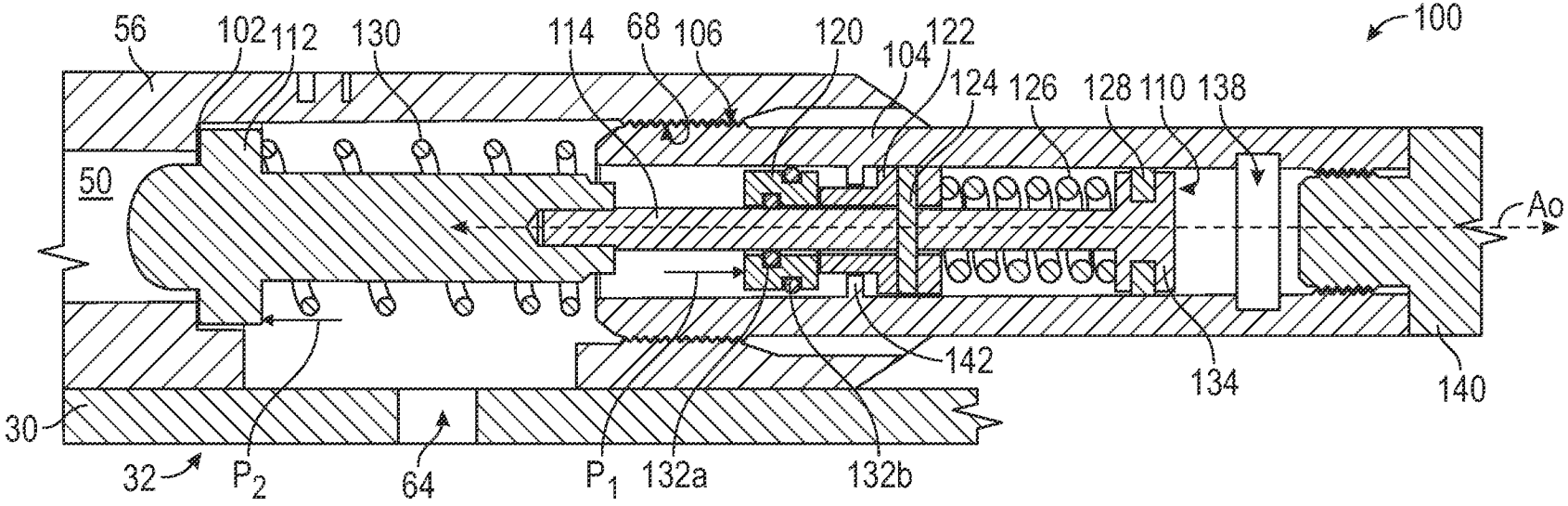
FIG. 3A is a cross-sectional side view of a mechanical isolation plug installed in the flow control device FIG. 2, the mechanical isolation plug in an initial configuration wherein the flow path through the flow control device is closed.
Figure 3B:
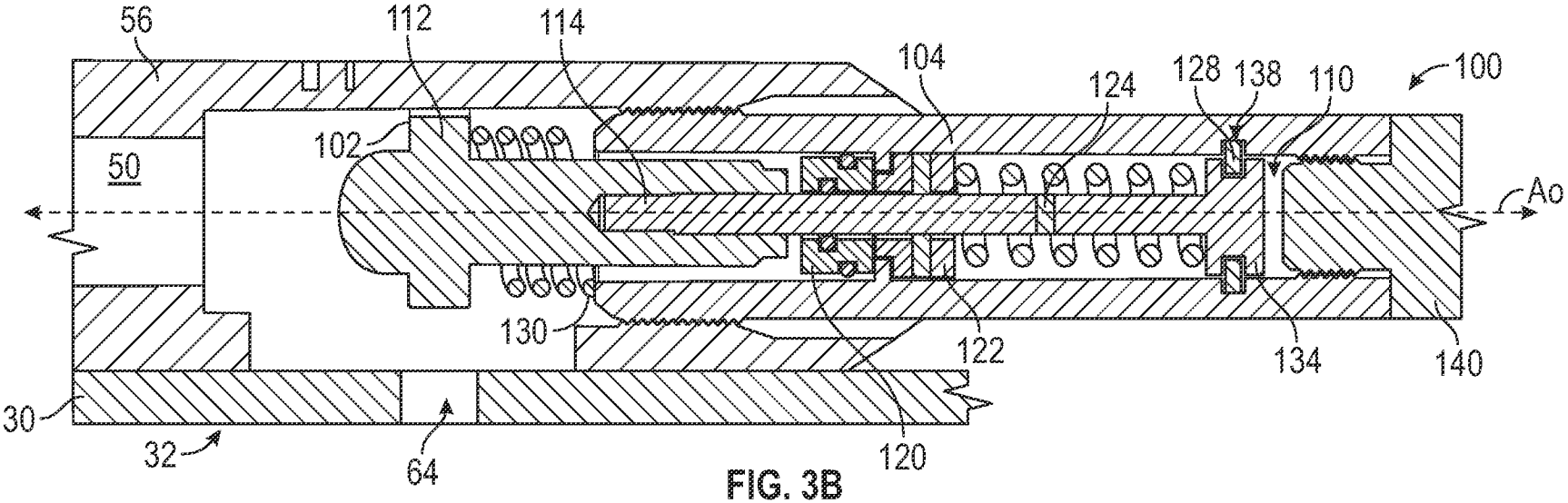
FIG. 3B is a cross-sectional side view of the mechanical isolation plug of 3A in an activated configuration wherein the flow path through the flow control device is open.

Referring to FIGS. 3A and 3B, an isolation plug 100 is disposed in the flow control housing 56 in an initial configuration (FIG. 3A) and an actuated configuration (FIG. 3B). In initial configuration of FIG. 3A, a sealing element 102 of the isolation plug 100 engages the flow control housing 56, thereby fluidly isolating the interior passageway 32 of the base pipe 30 from the fluid path 50 defined in the flow control housing 56. In the actuated configuration of FIG. 3B, the sealing element 102 is disengaged from the flow control housing 56 permitting fluid communication between the interior passageway 32 and the fluid path 50 through the radial openings 64. Once the isolation plug 100 is moved to the actuated configuration, the isolation plug 100 may be locked in the actuated configuration, as described in greater detail below, to permit production and/or injection operations to conducted through the flow control housing 56.

An outer sleeve 104 of the isolation plug 100 defines a longitudinal axis $A_0$ and includes NPT threads 106 on an exterior surface thereof for engaging the NPT threads 68 in the flow control housing 56. The outer sleeve 104 may thus be fixedly coupled to the flow control housing 56. An inner assembly 110 is slidably disposed within the outer sleeve 104. The inner assembly 110 generally includes a plunger 112 on which the sealing element 102 is disposed, and an elongate rod 114, which carries a piston 120, a slider block 122 and a shear member such as shear pin 124, a first biasing member such as strong spring 126 and a latch mechanism 128. The elongate rod 114 may be fixedly coupled to the plunger 112 by threads, welds or may be other connectors, and may thus, the entire inner assembly 110 may slide together in the initial configuration of FIG. 3A. In the initial configuration, a second biasing member such as weak spring 130 coupled between the outer sleeve 104 and the plunger 112 biases the inner assembly 110 in an up-hole direction where the sealing element 102 is engaged with the flow control housing 56. The weak spring 130 may be constructed as a compression coil spring, Bellville washers, etc. In some embodiments, the weak spring 130 may provide an axial force that is less than an axial force provided by the strong spring 126.

The piston 120 is carries seals 132*a* and 132*b* for sealing the piston 120 to the elongated rod 114 on an interior of the piston 120 and to an inner diameter of the outer sleeve 104 on an exterior of the piston 120. The seals 132*a*, 132*b* permit the piston 120 to slide along the elongated rod 114 within the outer sleeve 104 while maintaining the seals with the elongated rod 114 and outer housing 120. In the initial configuration, the shear pin 124 couples the slider block 122 to the elongated rod 114. The strong spring 126 may thus be maintained in a compressed configuration between the slider block 122 and a radially-extending flange 134 of elongated rod 114. The strong spring 126 may be constructed as a coiled compression spring, Bellville washers, or another compressible medium for storing mechanical energy. The radially-extending flange 134 carries the latch mechanism 128 thereon. As illustrated in FIG. 3A, the latch mechanism 128 may be constructed of a snap ring or collet maintained in a radially retracted configuration by the outer sleeve 104.

To move the isolation plug 100 to the actuated configuration of FIG. 3B, an activation pressure above a predetermined threshold may be applied and then relieved from the piston 120 as described in greater detail below. In the actuated configuration, the shear pin 124 has been sheared permitting the elongated rod 114 to move with respect to the slider block 122. The strong spring 126 expands to separate the radially-extending flange 134 from the slider block 122.

This separation permits the latch mechanism 128 to expand radially to engage an annular groove 138 defined on an interior of the outer sleeve 104. The latch mechanism 128 extends into the annular groove 138 to lock the elongated rod 114 in a retracted position within the outer sleeve 104, which in turn maintains the plunger 112 in a retracted position where the sealing element 102 is disengaged from the flow control housing 56. In the actuated configuration, the weak spring 130 is collapsed between the outer sleeve 104 and the plunger 112.

An end plug 140 is provided in the outer sleeve 104 and may be secured by threads, pins other connectors. The outer sleeve 104 also defines an interior shoulder 142 therein, extending radially inward between the piston 120 and the slider block 122. The inner shoulder 142 may facilitate retention of the inner assembly 110 and provides a foundation against which the strong spring 126 may expand.

Figure 4:
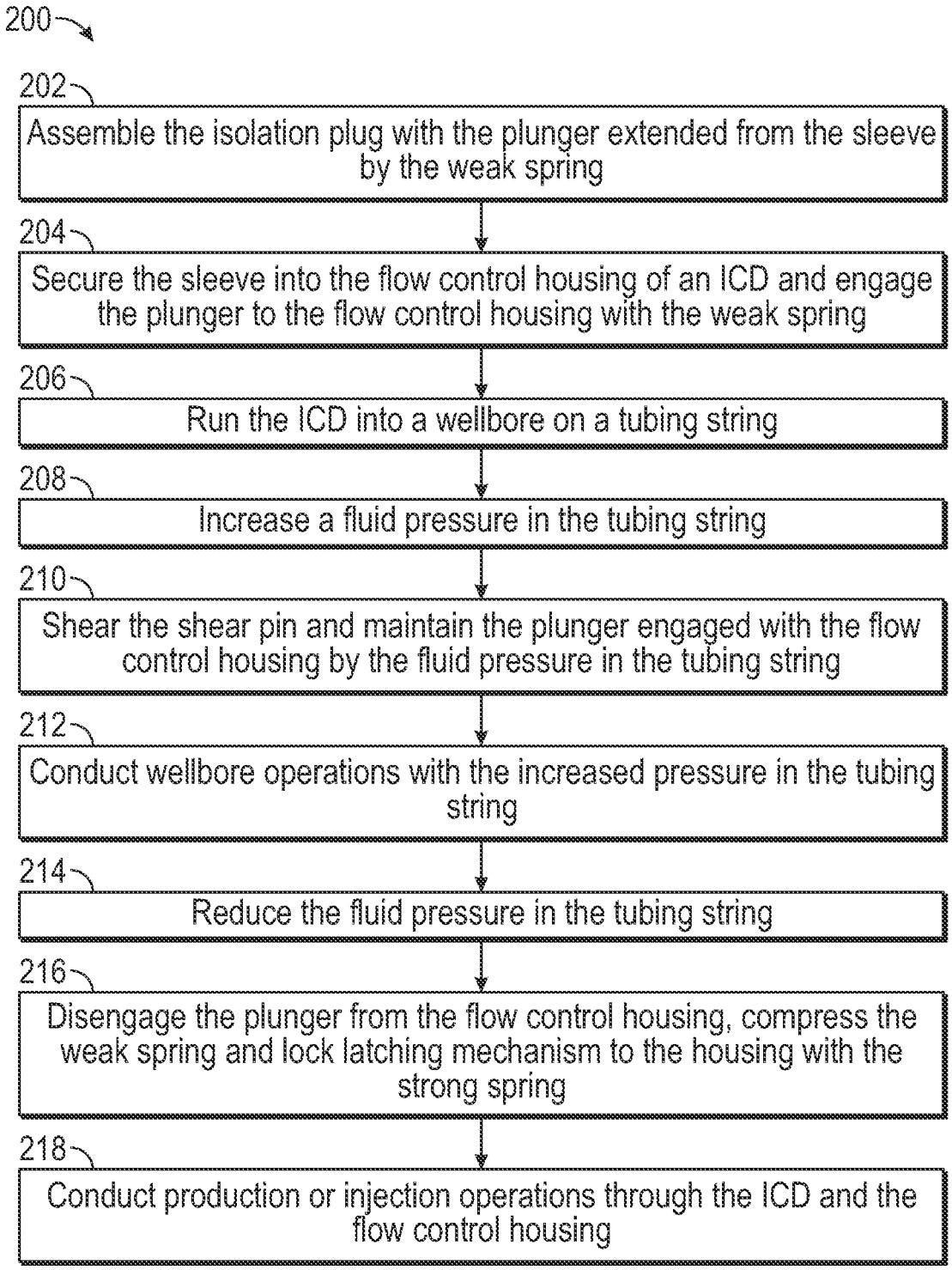
FIG. 4 is a flowchart illustrating an operational procedure for deploying and operating the mechanical isolation plug of FIGS. 3A and 3B.

Referring now to FIG. 4 with reference to FIG. 3A, an operational procedure 200 is described for use of the isolation plug 100. Initially at step 202, the isolation plug 100 is assembled. The strong spring 126 is compressed between the slider block 122 and the flange 134 of the elongated rod 114. The slider block 122 is then pinned to the elongated rod 114 with shear pin 124 and the latch mechanism 128 may be installed on the flange 134. The elongated rod 114 may then be inserted into the outer sleeve 104 until the latch mechanism 128 advances past the annular groove 138. The piston 120 may be inserted into the outer sleeve from an opposite end of the outer sleeve 104 to engage the elongated rod 114. Next, the plunger 112 may be coupled to elongated rod 114 by threading the plunger 112 to the elongated rod 114 inside the outer sleeve 104. The weak spring 130 may be captured between the plunger 112 and the outer sleeve 104 when the plunger 112 is threaded to the elongated rod 114. The end cap 140 may then be installed on the outer sleeve 104 to complete the assembly of the isolation plug 100. Once assembled, the plunger 112 will extend from the outer sleeve 104, biased outward by the weak spring 130.

Next, at step 204, the isolation plug 100 is secured to the flow control housing 56 of an ICD by engaging the NPT threads 106 on the outer sleeve 104 with the NPT threads 68 in the flow control housing 56. The weak spring 130 extends the piston 112 such that the sealing element 102 may engage the flow control housing 56 to close the fluid path 50. The ICD may then be run into a wellbore on a tubing string (step 206). As the ICD is run into the wellbore, a fluid pressure in the fluid path 50 may be sufficient to counteract the bias of the weak spring 130 such that the piston 112 disengages the flow control housing 56, and fluid from the fluid path 50 may enter the base pipe 30 through radial openings 64.

Once the ICD is in position in the wellbore, the procedure 200 may advance to step 208 where a pressure in the interior passageway 32 of the base pipe 30 is increased. The pressure may be increased, for example, as a fluid is pumped down for washover or circulation operations. The fluid pressure in the interior passageway 32 is applied to the piston 120 in the direction of arrow $P_1$ and to the plunger 112 in the direction of arrow $P_2$. The fluid pressure together with the weak spring 130 maintains the sealing element 102 on the plunger 112 engaged with the flow control housing 56. The fluid path 50 remains fluidly isolated from the interior passageway 32. The pressure in the interior passageway 32 may be increased sufficiently to shear the shear pin 124 (step 210). The pressure acting on the piston 120 in the direction of arrow $P_1$ (FIG. 3A) pushes the piston 120 and the slider block 122 in the direction of arrow $P_1$, while the pressure acting on the plunger 112 in the direction of arrow $P_2$ maintains the position of the plunger 112 and the elongated rod 114 connected thereto with respect to the flow control housing 56 and the outer sleeve 104. Since the shear pin 124 extends through both the slider block 122 and the elongated rod 114, the movement of the slider block 122 with respect to the elongated rod will shear the shear pin 124, and the pressure acing acting on the plunger 112 in the direction of arrow $P_2$ maintains the plunger 112 in a sealing relationship with the flow control housing 56.

At step 212, the washover, circulation or other wellbore operations may be conducted with the plunger 112 maintained in the sealing relationship with the flow control housing 56 and with the shear pin 124 sheared. Once the wellbore operations are complete, the pressure in interior passageway 32 may be reduced (step 214). The reduced pressure will permit the plunger 112 to move with respect to the flow control housing 56 under the bias of the strong spring 126, which is free to expand once the shear pin 124 has been sheared. At step 216, the plunger 112 is disengaged from the fluid control housing 56 and the weak spring 130 is compressed by the plunger moving under the bias of the strong spring 126. The expansion of the strong spring 126 moves the flange 134 of the elongated rod 114 until the latch mechanism 128 engages the annular groove 138 as illustrated in FIG. 3B. The latch mechanism 128 engages the annular groove 138 to lock the isolation plug 100 in an actuated configuration where the plunger 112 is in a disengaged relation with respect to the flow control housing 56. In the actuated configuration, fluid path 50 is in fluid communication with the interior passageway 32 of the base pipe 30. Thus, production or injection operations may be conducted by passing fluids between the wellbore 12 (FIG. 1) and the base pipe 30 through the ICD and the flow control housing (step 218).

Figure 5:
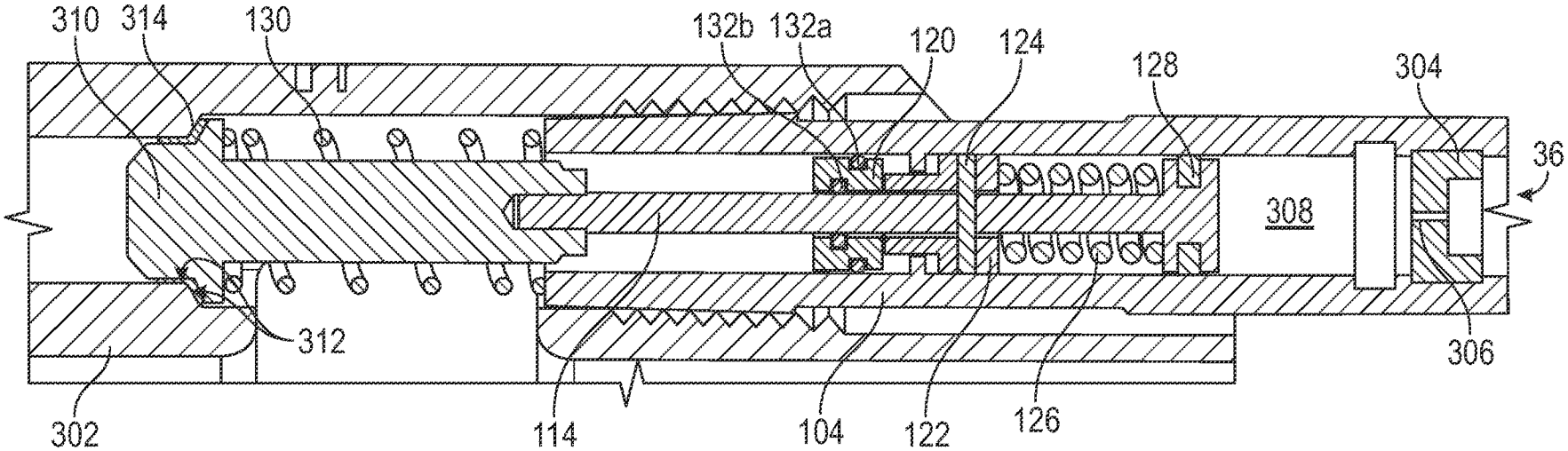
FIG. 5 is a cross-sectional side view of an alternate embodiment of an isolation plug including a pressure relief port defined through an end thereof.

Referring now to FIG. 5, an embodiment of an isolation plug 300 is coupled to a flow control housing 302. The isolation plug 300 operates substantially similarly to the isolation plug 100 described above. The outer sleeve 104, elongated rod 114, piston 120 with seals 132*a*, 132*b*, slider block 122, shear pin 124 strong spring 126 and latch mechanism 128 may operate as described above. The isolation plug 300 includes an end cap 304 with a pressure a pressure relief port 306 defined therethrough. The pressure relief port 306 may be a relatively small opening in the end cap 304 that permits fluid communication between annulus 36 and a chamber 308 defined between the seals 132*a*, 132*b* and the end cap 304. The pressure relief port 306 facilitates movement of the elongated rod 114 by preventing a pressure lock condition by a fluid trapped in the chamber 308.

The isolation plug 300 also includes a plunger 310 defining a generally L-shaped profile for engaging a generally L-shaped seat 312 defined in flow control housing 302. A generally L-shaped seal member 314 may engage the flow control housing across multiple surfaces, thereby forming an effective seal in the initial configuration illustrated.

Figure 6A:
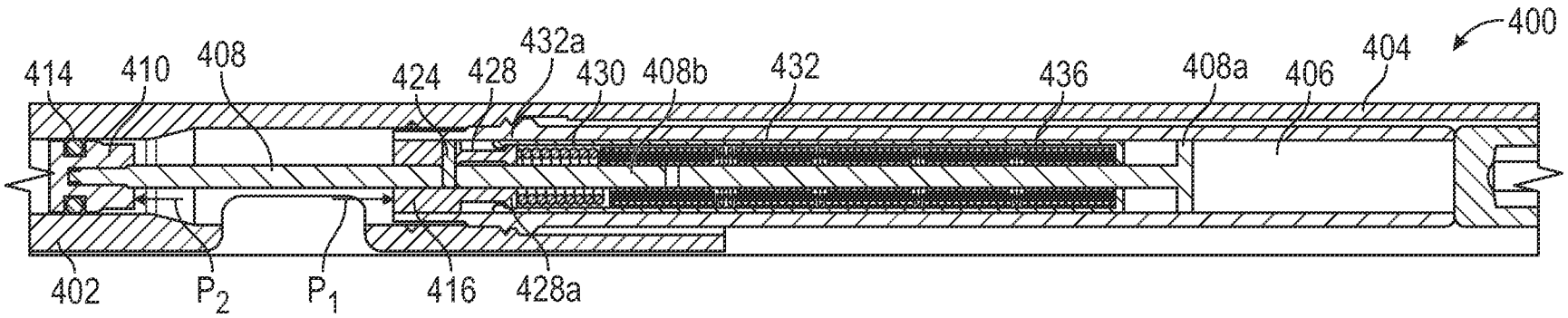
FIGS. 6A through 6C are cross-sectional side views of an alternate embodiment of an isolation plug in initial, intermediate and actuated configurations, respectively, illustrating a sliding sleeve and a collet for maintaining the isolation plug in an actuated configuration.

Referring to FIG. 6A, another embodiment of an isolation plug 400 is coupled to a flow control housing 402. The isolation plug 400 includes a protective cover 404 coupled to the flow control housing 402 extending over an outer sleeve 406. The protective cover 404 may extend around a plurality of circumferentially-spaced isolation plugs 400 on a base pipe 30 (FIG. 2). The protective cover 404 and outer sleeve 406 may both be fixedly coupled to the flow control housing 402 but may not necessarily be coupled to one another.

An elongated rod 408 includes a flange 408*a* at a first end extending into the outer sleeve 406 and is coupled at an opposite end to a plunger 410. The plunger 410 carries a seal member 414 for sealing with the flow control housing 402 when engaged therewith. In some embodiments, the seal member 414 may be constructed as an elastomeric O-ring. A piston 416 is coupled to the elongated rod 408 with a shear pin 424, which may be selectively sheared to separate the piston 416 from the elongated rod 408 as described below. In some embodiments, the piston 416 may be fixedly coupled to the outer sleeve 406. Abutting the piston 416 is a collet 428, which in turn abuts a coil spring 430. A head 428*a* of the collet and the coil spring 430 are disposed within a sliding sleeve 432, which also houses a stack of disc springs 436. The head 428*a* of the collet 428 may be biased radially inward and may be maintained in a radially outward position by engagement with the elongated rod 408. In the radially outward position, the head 408*a* of the collet 408 is maintained inside the sliding sleeve 432 by a lip 432*a* at and end of the sliding sleeve 432.

In operation, a pressure from an interior of a base pipe 30 (FIG. 2) may be applied to the piston 416 in the direction of arrow $P_1$ and to the plunger 410 in the direction of arrow $P_2$. The pressure maintains the plunger 410 engaged with the flow control housing 402 and closes a flow path therethrough. When the pressure reaches a threshold activation pressure, the shear pin 424 will shear due to the activation pressure acting in opposite directions on the plunger 410 and the piston 416. With the activation pressure applied, the isolation plug moves to the intermediate configuration of FIG. 6B.

Figure 6B:
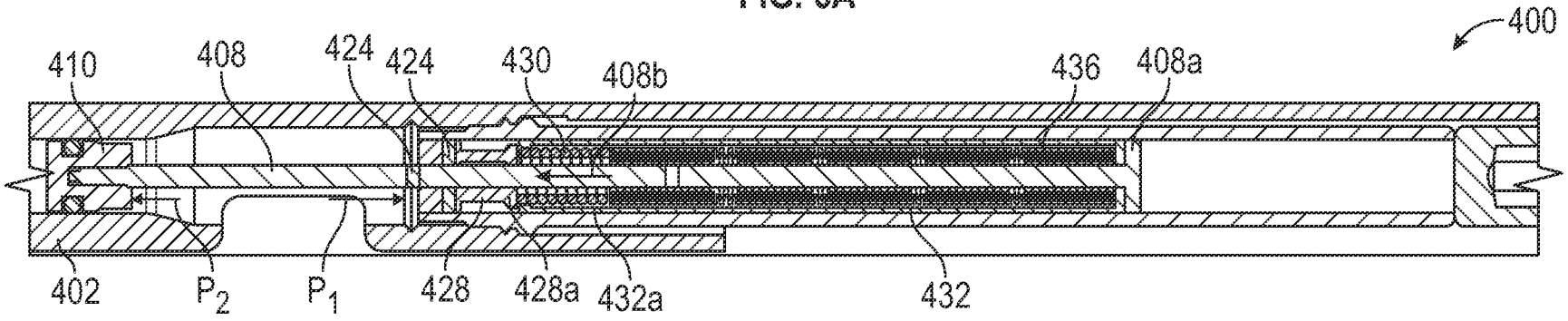

As illustrated in FIG. 6B, once the shear pin 424 is sheared, the plunger 410 moves with respect to the flow control housing 402 in the direction of arrow $P_2$ under the activation pressure. The plunger 410 draws the elongated rod 408 in the direction of arrow $P_2$ until a narrowed section 408*b* of the elongated rod 408 reaches the head 428*a* of the collet 428. The head 428*a* of the collet is permitted to move radially inward such that the lip 432*a* of the sliding sleeve 432 may move past the head 428*a*. The disc springs 436 and the coil spring 430 may expand to press the sliding sleeve 432 in the direction of arrow $P_1$ against the flange 408*a*. The intermediate configuration of FIG. 6B may be maintained until the pressure applied to the plunger 410 is reduced.

Figure 6C:
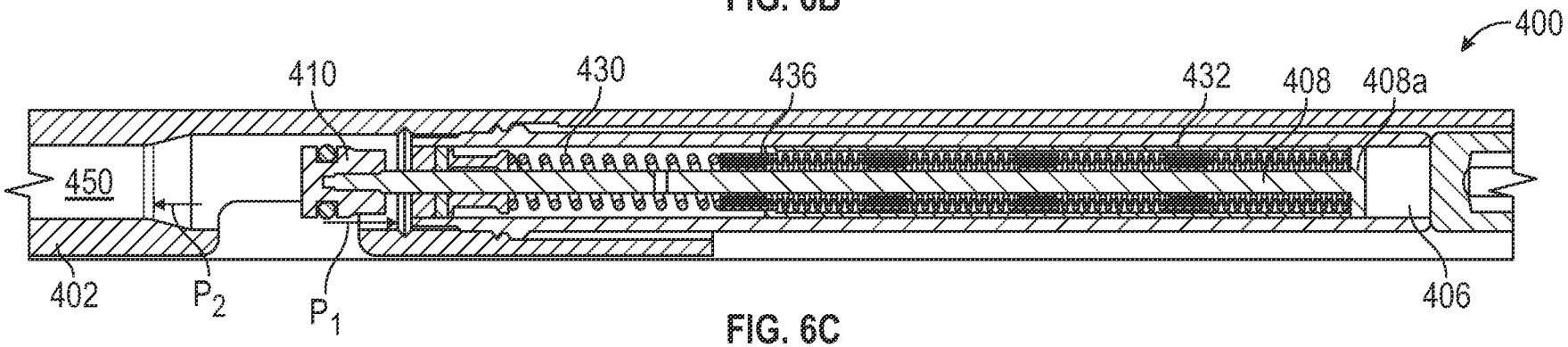

As illustrated in FIG. 6C, once the pressure applied to the plunger 410 is reduced sufficiently, a force applied by the disc springs 436 and coil spring 430 the siding sleeve 432 and the flange 408*a* of the elongated rod 408 in the direction of arrow $P_1$ overcomes a force of the pressure applied to the plunger 410 in the direction of arrow $P_2$. The springs 436, 430 are permitted to expand, causing the elongated rod 408 to move in the direction of arrow $P_1$ with respect to the flow control housing 402 and outer sleeve 406. The elongated rod 408 draws the plunger 410 out of engagement with the flow control housing 402, thereby opening a fluid path 450 therethrough.

Figure 7:
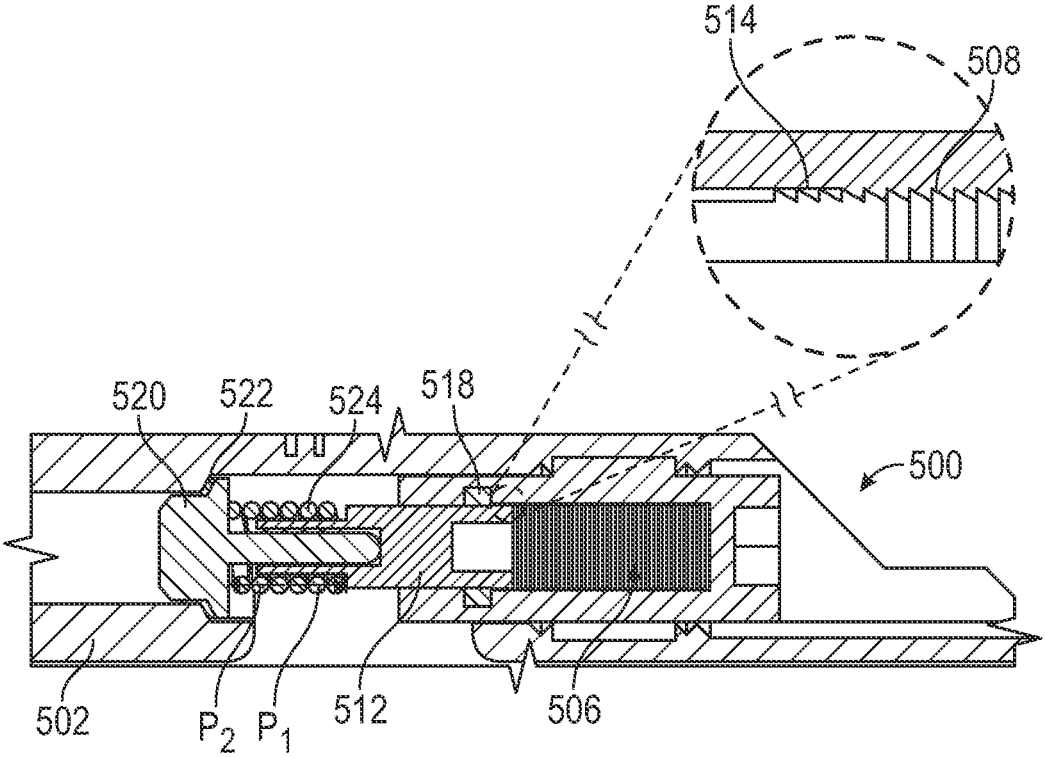
FIG. 7 is a cross-sectional side view of an alternate embodiment of an isolation plug including a ratchet for maintaining the isolation plug in both initial and actuated configurations.

Referring to FIG. 7, another embodiment of an isolation plug 500 is coupled to a flow control housing 502. The isolation plug 500 includes an outer sleeve 506, which defines a plurality of one-way ratchet teeth 508 defined therein. A piston 512 includes ratchet teeth 514 for engaging the ratchet teeth 508 of the outer sleeve 506. A sealing element 518 provides a fluid seal between the piston 512 and the outer sleeve 506. A plunger 520 is slidably disposed within the elongated rod 506 and includes an l-shaped sealing element 522 thereon for engaging the flow control housing 502. A coil spring 524 is coupled between the plunger 520 and the piston 512 and provides a tensile force therebetween.

In operation, an activation pressure may be applied to the interior of a base pipe 30 (FIG. 3A) the piston 512 and the plunger 520 in the directions of $P_1$ and $P_2$, respectively. The activation pressure may maintain the plunger 520 engaged with the flow control housing 502 such that a flow path therethrough is closed. The pressure may also urge the piston 512 to move in the direction of arrow $P_1$. The one-way ratchet teeth 508, 514 permit relative movement of the piston 512 in the direction of arrow $P_1$ but prohibit movement in the opposite direction of arrow $P_2$ with respect to the outer sleeve 506. The coil spring 524 is stretched as the piston 512 moves under the influence of the pressure. When the pressure is relieved, the coil spring 524 draws the plunger 520 in the direction of arrow $P_1$, which disengages the plunger 520 from the flow control housing 502. The one-way ratchet teeth 508, 514 maintain the axial position of the piston 512 such that the plunger remains disengaged from the flow control housing 502 once the activation pressure is relieved.

Figure 8:
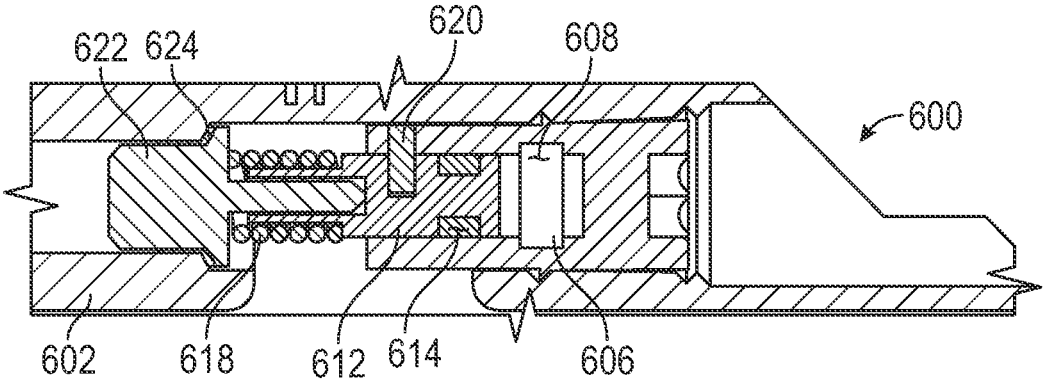
FIG. 8 is a cross-sectional side view of an alternate embodiment of an isolation plug including a shear pin for maintaining the isolation plug in an initial configuration and a lock ring for maintaining the isolation plug in an actuated configuration.

Referring to FIG. 8, another embodiment of an isolation plug 600 is coupled to a flow control housing 602. The isolation plug 600 includes an outer sleeve 606, which defines annular groove 608 on an interior thereof. A piston 612 carries a latch mechanism 614 thereon, and a tensile spring 618 is provided between the piston 612 and a plunger 622 carrying a sealing element 624 thereon. A shear pin 620 temporarily couples the piston 612 to the outer sleeve 606. The isolation plug 600 may operate in a manner similar to the isolation plug 500 (FIG. 7) described above. A pressure may be applied maintain the plunger 622 engaged with the flow control housing 602 such that a flow path therethrough is closed. Once the pressure is sufficient to shear the shear pin 620, the pressure may also urge the piston 612 to move relative outer sleeve 606 until the latch mechanism 614 engages the annular groove 608 maintaining the position of the piston 612 within the outer sleeve 606. Thus, once the pressure is relieved, the spring 618 may draw the plunger 622 toward the outer sleeve opening the flow path through the flow control housing 602.

Figure 9:
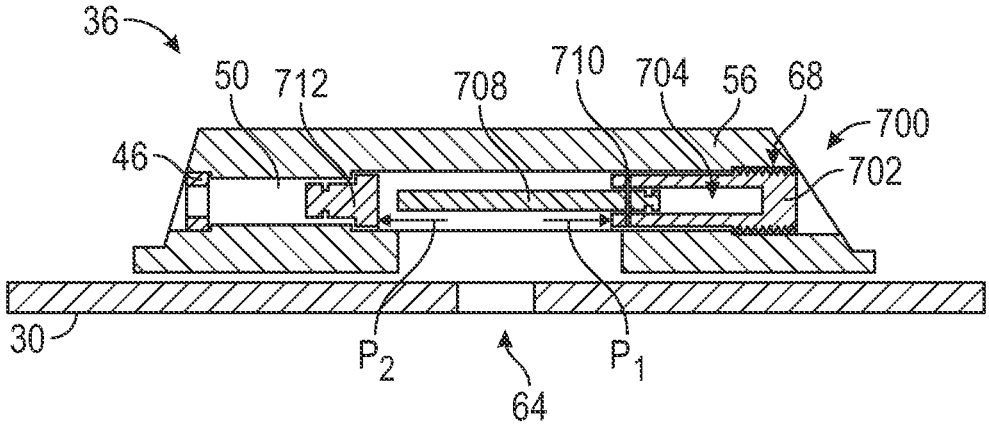
FIG. 9 is a cross-sectional side view of an alternate embodiment of an isolation plug including an atmospheric chamber for maintaining the isolation plug in an initial configuration.

Referring to FIG. 9, another embodiment of an isolation plug 700 may be deployed in the flow control housing 56 described above. An outer sleeve 702 is threaded into the NPT threads 68 of the flow control housing 56 and includes an atmospheric chamber 704 defined therein. The atmospheric chamber 704 may contain air or another fluid installed generally at an atmospheric pressure at the surface. An elongated rod 708 is coupled to the outer sleeve 702 by a shear pin 710. A plunger 712 is disposed in the fluid path 50 and may form a seal with the flow control housing 56 to close the flow path 50 between the nozzles 46 and the radial openings 64 defined in the base pipe 30. In other embodiments, the plunger 712 may be constructed as a ball (see FIG. 10) without departing from the scope of the disclosure.

In operation, the elongated rod 708 maintains the plunger 712 in the flow path 50 during run-in operations. The elongated rod 708 may be axially spaced from the plunger 712 as illustrated, and in other embodiments, a spring or other biasing mechanism (not shown) may be provided between the elongated rod 708 and the plunger to bias the plunger in the direction of arrow $P_2$ into engagement with the flow control housing 56. An activation pressure may be applied through the radial openings 64 in the base pipe 30 to maintain the plunger 712 engaged with the flow control housing 56 and to shear the shear pin 710. Once the shear pin 710 is sheared, the elongated rod 708 may be permitted to move in the direction of arrow $P_1$ into the atmospheric chamber 704. With the elongated rod 708 moved into the atmospheric chamber 704, the plunger 712 may be permitted to move in the direction of toward the atmospheric chamber 704 once the activation pressure is reduced. A pressure from the annulus 36 (FIG. 2) surrounding the flow control housing 56 may be applied through the nozzles 46 to facilitate dislodging the plunger 712 form the flow path 50. In some embodiments, the plunger 712 may be caused to move through the radial openings 64, into the base pipe 30 such that the flow path will remain open during production operations.

Figure 10:
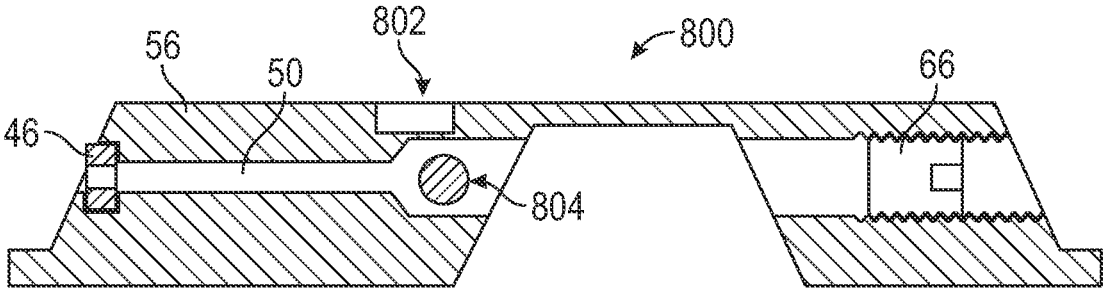
FIG. 10 is a cross-sectional side view of an alternate embodiment of an isolation plug including a magnetic ball for maintaining the isolation plug in an initial configuration.

Referring to FIG. 10, another embodiment of an isolation plug 800 may be deployed in the flow control housing 56. The isolation plug 800 includes a magnet 802 on an outer surface of the flow control housing and a magnetic ball 804 disposed within the flow path 50. The magnetic ball 804 may be attracted to the magnet 802 to retain the magnetic ball 804 during run-in operations, and an activation pressure, e.g., applied by washdown or circulation operations, may be applied to seat the ball 804 in engagement with the flow control housing 56 to close the flow path 50. The activation pressure may be reduced, and production operations may be conducted through the flow path 50. Sufficient production through the nozzles 46 may cause the ball 804 to dislodge from the flow path 50 such that the magnet 802 no longer sufficiently attracts the ball 804 to retain the ball 804. The ball 804 may then be retained or permitted to fall through the radial openings 64 such that the flow path 50 remains open throughout the production operations.

Figure 11A:
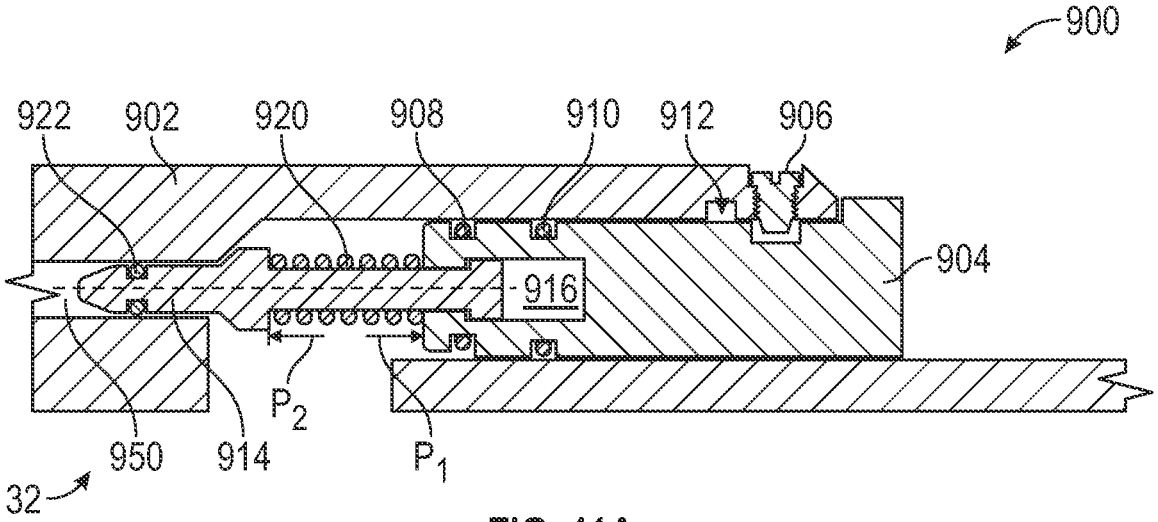
FIGS. 11A and 11B are cross-sectional side views of an alternate embodiment of an isolation plug in initial and actuated configurations, respectively, illustrating a spring-loaded dart that is maintained in the initial position by a shear pin, and immediately moves to an actuated position upon shearing of the shear pin.

FIG. 11A illustrates another embodiment of an isolation plug 900 in an initial or run-in configuration within a flow control housing 902. The isolation plug 900 includes a piston 904, which is coupled to the flow control housing 902 with a shear screw 906. The piston 904 carries a sealing element 908 and a snap ring 910 on an exterior surface thereof for engaging the flow control housing 902. An annular groove 912 is defined within the flow control housing 902 to receive the snap ring 910 as described below. A plunger 914 protrudes from a cavity 916 within the piston 904 and is biased in the direction of arrow $P_2$ by a spring 920 coupled between the piston 904 and the plunger 914. In other embodiments, the spring 920 may be carried within the cavity 916 to bias the plunger 914. A sealing element 922 is carried by the plunger 914 and may close a fluid path 950 through the flow control housing 902.

In the initial configuration, the plunger 914 operates as a check valve permitting only one-way flow through the fluid path 950. When a fluid pressure in the fluid path 950 is sufficient to counteract the bias of spring 920, the plunger 914 may be pushed into the cavity 916 to permit fluid flow into the interior passageway 32 of a base pipe 30 (FIG. 2). When a fluid pressure in the interior passageway 32 is increased however, the pressure presses on the plunger 914 in the direction of arrow $P_2$ maintaining the plunger 914 engaged with the flow control housing 902.

Figure 11B:
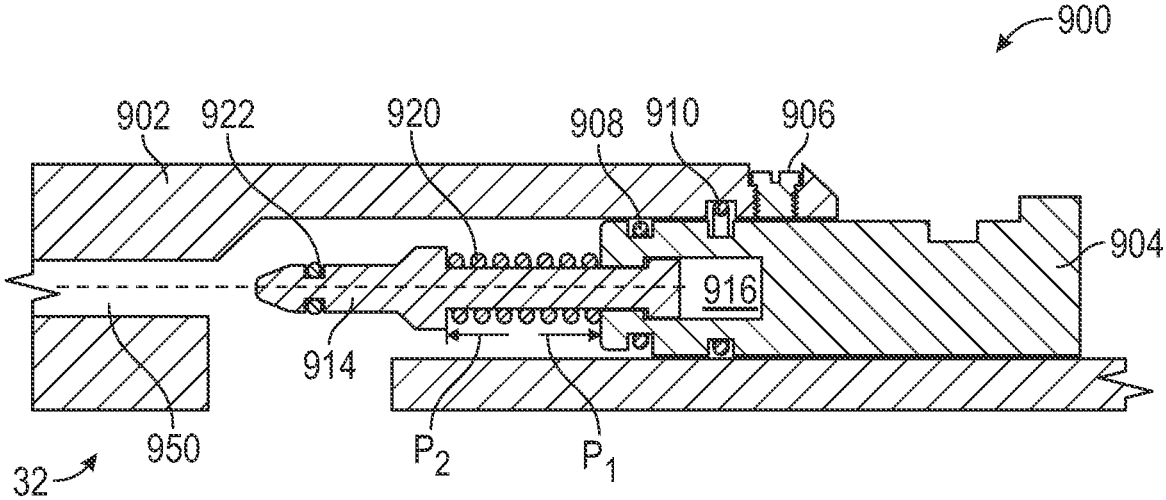

Referring now to FIG. 11B, the isolation plug 900 may be moved to an open configuration where the fluid path 950 is maintained open. Pressure within the interior passageway 32 may be increased until an activation pressure is reached and a force generated between the sealing elements 908, 922 is sufficient to shear the shear screw 906. Immediately after shearing the shear screw, the activation pressure may move the piston 904 in the direction of arrow $P_1$ until the snap ring 910 reaches the annular groove 912 and locks the piston 904 in place within the flow control housing 902. The plunger 914 disengages the flow control housing 902 opening the fluid path 950 through the flow control housing 902. The open configuration is maintained by the engagement of the snap ring 910 with the annular groove 912.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a wellbore flow control system including a base pipe defining an interior passageway and having at least one radial opening defined therein. A flow control housing is secured to the base pipe and defines a flow path extending to the radial opening in the base pipe. A piston is disposed in the flow path, and the piston is responsive to the application of an activation pressure from the interior passageway of the base pipe to move in a first direction from an initial position. A plunger is disposed in the flow path, and the plunger is responsive the application of activation pressure to move in a second direction opposite the first direction to engage the flow control housing and thereby close the flow path. A first biasing member is operably coupled to the plunger to urge the plunger in the first direction to disengage the flow control housing in response to relief of the activation pressure. A latch is operably coupled to the piston to move in the first direction in response to the application of the activation pressure, and the latch is operably coupled to the plunger to maintain the plunger disengaged from the flow control housing in response to relief of the activation pressure.

In some embodiments, the system further includes an outer sleeve having a connector thereon for selectively coupling the outer sleeve to the flow control housing. The piston, plunger, first biasing member and latch may all be carried by the outer sleeve. In some embodiments, the connector on the outer sleeve includes a thread engaged with a corresponding thread defined in an access port of the flow control housing. The latch may engage the outer sleeve to maintain the plunger disengaged from the flow control housing.

In one or more embodiments, the system further includes a second biasing member operably coupled to plunger to bias the plunger in the second direction into engagement with the flow control housing when the piston is disposed in the initial position and operable to permit the plunger to disengage the flow control housing when the piston is moved to an activated position and the activation pressure is relieved. The first biasing member may include a relatively strong spring and the second biasing member comprises a relatively weak spring, and wherein the relatively strong spring counteracts the bias of the relatively weak spring. In some embodiments, the system further includes a shear member operably coupled to the relatively strong spring to prevent the relatively strong spring from counteracting the bias of the relatively weak spring when the piston is in the initial position, and wherein the shear member shears in response to the application of the activation pressure to permit the strong spring to counteract the bias of the relatively weak spring. In some embodiments, the system further includes an elongated rod operably coupled between the piston and the plunger by the shear member, the elongated rod placed in tension by the application of the activation pressure.

In some embodiments, the latch includes at least one of the group consisting of a snap ring, a collet, and one-way ratchet teeth. The system may further include a flow control screen including an outer sheath and a filter element disposed around the base pipe in fluid communication with the flow path defined in the flow control housing. In some embodiments, the system further includes an end cap coupled to the flow control housing to define a chamber between the piston and the end cap, the end cap defining a pressure relief port therethrough.

In another aspect, the disclosure is directed to a method of operating a wellbore flow control system. The method includes (a) running a base pipe into a wellbore on a tubing string, (b) applying an activation pressure to a flow control housing coupled the base pipe by increasing a fluid pressure in the tubing string, (c) urging a piston and a plunger in opposite first and second directions by the activation pressure, the piston urged in the first direction from an initial position in the flow control housing to an activated position, and the plunger urged in the second direction to engage the flow control housing and thereby close flow path extending through the flow control housing to the base pipe, (d) conducting wellbore operations while applying the activation pressure to maintain the plunger engaged with the flow control housing, and thereafter (e) relieving the activation pressure to permit a first biasing member to disengage the plunger from the flow control housing to thereby open the flow path through the flow control housing and to permit a latch to lock the plunger in a disengaged position with respect to the flow control housing.

In one or more embodiments, the method further includes installing an outer sleeve into an access port of the flow control housing, wherein the piston, plunger, first biasing member and latch are all carried by the outer sleeve. In some embodiments, the method further includes urging the plunger in the second direction with a second biasing member to engage the flow control housing while the piston is disposed in the initial position. The method may further include shearing a shear member with the activation pressure to permit the first biasing member to counteract a bias of the second biasing member.

In some embodiments, urging the piston in the first direction further comprises engaging ratchet teeth on the piston with ratchet teeth defined within the flow control housing. Engaging the ratchet teeth on the piston further comprises engaging one-way ratchet teeth such that the piston is locked in an actuated position to lock the plunger in the disengaged position. In one or more embodiments, conducting wellbore operations while applying the activation pressure further comprises conducting washdown or circulation operations, and the method may further include conducting production or injection operations through the flow control housing with the plunger locked in the disengaged configuration.

According to another aspect, the disclosure is directed to an isolation plug apparatus for a wellbore flow control system. The isolation plug apparatus includes an outer sleeve having a connector thereon for selectively coupling the outer sleeve to a flow control housing of the flow control system. A piston is disposed in the outer sleeve. The piston is responsive to the application of an activation pressure to move in a first direction from an initial position within the outer sleeve.

A plunger extends from the outer sleeve. The plunger is responsive to the application of the activation pressure to move in a second direction opposite the first direction. A first biasing member is operably coupled to the plunger to urge the plunger in the first direction in response to relief of the activation pressure, and a latch is operably coupled to the piston to move in the first direction in response to the application of the activation pressure. The latch is operably coupled to the plunger to lock the plunger in a retracted position with respect to the outer sleeve in response to relief of the activation pressure.

In one or more embodiments, the apparatus further includes a second biasing member operably coupled to plunger to bias the plunger in the second direction to an extended position with respect to the outer sleeve when the piston is disposed in the initial position.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of operating a wellbore flow control system, the method comprising:

running a base pipe into a wellbore on a tubing string;

applying an activation pressure to a flow control housing coupled the base pipe by increasing a fluid pressure in the tubing string;

urging a piston and a plunger in opposite first and second directions by the activation pressure, the piston urged in the first direction from an initial position in the flow control housing to an activated position, and the plunger urged in the second direction to engage the flow control housing and thereby close flow path extending through the flow control housing to the base pipe;

conducting wellbore operations while applying the activation pressure to maintain the plunger engaged with the flow control housing; and thereafter relieving the activation pressure to permit a first biasing member to disengage the plunger from the flow control housing to thereby open the flow path through the flow control housing and to permit a latch to lock the plunger in a disengaged position with respect to the flow control housing.

2. The method of claim 1; further comprising installing an outer sleeve into an access port of the flow control housing, wherein the piston, plunger, first biasing member and latch are all carried by the outer sleeve.

3. The method of claim 1 further comprising urging the plunger in the second direction with a second biasing member to engage the flow control housing while the piston is disposed in the initial position.

4. The method of claim 3, further comprising shearing a shear member with the activation pressure to permit the first biasing member to counteract a bias of the second biasing member.

5. The method of claim 1, wherein urging the piston in the first direction further comprises engaging ratchet teeth on the piston with ratchet teeth defined within the flow control housing.

6. The method of claim 5, wherein engaging the ratchet teeth on the piston further comprises engaging one-way ratchet teeth such that the piston is locked in an actuated position to lock the plunger in the disengaged position.

7. The method of claim 1, wherein conducting wellbore operations while applying the activation pressure further comprises conducting washdown or circulation operations, and wherein the method further comprises conducting production or injection operations through the flow control housing with the plunger locked in the disengaged configuration.

8. A method of controlling fluid flow in a wellbore; the method comprising:

assembling an isolation plug into a flow control housing of an inflow control device such that a plunger of the isolation plug engages the flow control housing and thereby closes a flow path through the flow control housing;

running the inflow control device into the wellbore on a base pipe fluidly coupled to the flow path through the flow control housing;

applying an activation pressure through the interior passageway of the base pipe;

urging the plunger to maintain engagement with the flow control housing with the activation pressure;

urging a piston to unlock a first biasing member with the activation pressure;

relieving the activation pressure to permit the first biasing member to disengage the plunger from the flow control housing to thereby open the flow path through the flow control housing; and flowing fluid between the base pipe and the inflow control device through the flow path with the plunger disengaged from the flow control housing.

9. The method of claim 8, wherein assembling the isolation plug into the flow control housing comprises threading an outer sleeve of the isolation plug into an access port defined in the flow control housing.

10. The method of claim 8, where assembling the isolation plug into the flow control housing comprises engaging a seal member between the plunger and the flow control housing.

11. The method of claim 8, wherein unlocking the first biasing member comprises shearing a shear member with the piston and the activation pressure.

12. The method of claim 8, further comprising urging the plunger in a first direction into engagement with the flow control housing with a second biasing member.

13. The method of claim 12, further comprising counteracting a bias of the second biasing member in the first direction with a bias of the first biasing member in a second direction opposite the first direction.

14. The method of claim 8, further comprising latching the plunger in the isolation plug in response to applying the activation pressure such that the plunger is maintained in a disengaged position with respect to the flow control housing in response to relieving the activation pressure.

15. A method of controlling fluid flow through an inflow control device; the method comprising:

assembling an isolation plug into a flow control housing of the inflow control device such that a plunger of the isolation plug engages the flow control housing and thereby closes a flow path through the flow control housing;

applying an activation pressure to the flow path;

urging the plunger in a first direction with the activation pressure to maintain engagement between the plunger and the flow control housing;

urging a piston in a second direction with the activation pressure to apply a bias to the plunger in the second direction opposite the first direction; and relieving the activation pressure to permit the bias to the plunger in the second direction to disengage the plunger from the flow control housing to thereby open the flow path through the flow control housing.

16. The method of claim 15, wherein assembling the isolation plug into the flow control housing comprises installing the isolation plug through an access port extending to an exterior of the flow control housing.

17. The method of claim 15, wherein urging the piston in the second direction shears a shear member to unlock a first biasing member for biasing the piston in the second direction.

18. The method of claim 17, further comprising biasing the plunger in the first direction with a second biasing member, wherein the first biasing member imparts a greater force to the plunger than the second biasing member.

19. The method of claim 15, further comprising latching the plunger to an outer sleeve of the isolation plug after disengaging the plunger from the flow control housing.

20. The method of claim 15, further comprising running the inflow control device into a wellbore prior to applying the activation pressure and flowing fluid through the inflow control device subsequent to relieving the activation pressure.

* * * * *